US006450929B1

(12) United States Patent
Markham

(10) Patent No.: US 6,450,929 B1
(45) Date of Patent: Sep. 17, 2002

(54) DOOR MOUNTED EXERCIZING DEVICE

(76) Inventor: Douglas J. Markham, 3835R E. Thousand Oaks Blvd., #130, Westlake Village, CA (US) 91362

( * ) Notice: Subject to any disclaimer, the term of this patent is extended or adjusted under 35 U.S.C. 154(b) by 407 days.

(21) Appl. No.: 09/039,466

(22) Filed: Mar. 16, 1998

(51) Int. Cl.[7] ..... A63B 21/00
(52) U.S. Cl. ..... 482/121; 482/904; 482/126
(58) Field of Search ..... 482/904, 121, 482/129

(56) References Cited

U.S. PATENT DOCUMENTS 4,779,867 A * 10/1988 Hinds ..... 482/904
4,948,117 A * 8/1990 Burke ..... 482/129
5,556,369 A * 9/1996 Roberts ..... 482/904
5,571,064 A * 11/1996 Holm ..... 482/904
5,595,559 A * 1/1997 Viel ..... 482/904
5,709,630 A * 1/1998 Froelich, Sr. et al. ..... 482/46

FOREIGN PATENT DOCUMENTS

NL 8203510 * 4/1983 ..... 482/904

OTHER PUBLICATIONS

Malby and Son Photo Litho Figs 1 and 2 482/129 Sheet 1 Games and Toy Exercising Machines, 1894.*

* cited by examiner

*Primary Examiner*—Jerome W. Donnelly
(74) *Attorney, Agent, or Firm*—Jack C. Munro

(57) ABSTRACT

An exercizing device which includes a pair of handles which are connected to an elastic cord. At the approximate mid-point of the length of the elastic cord, there is mounted a loop strap. The loop strap is to be conducted between a door and a doorjamb with the loop strap being mounted on the doorknob of the door.

6 Claims, 2 Drawing Sheets

DOOR MOUNTED EXERCIZING DEVICE

BACKGROUND OF THE INVENTION

1) Field of the Invention

The present invention relates generally to an exercising device which is to supply resistance to the user through the use of a stretchable elastic cord and more particularly to an exercising device which is to be readily portable and connectable with a door when it is used.

2) Description of the Prior Art

Elastic cords have long been known to be usable in conjunction with exercise devices of various types. The elastic cord is to be connected at one end to a fixed object and then at the opposite end to one or more handles. The handles are to be grasped by the user and pulled, stretching the cord. This pulling action creates resistance and, by the user overcoming this resistance, strengthening exercises within a person's arms and legs can be obtained. Exercising by a human is desirable to achieve a standard of physical fitness or to recuperate from an illness or injury.

There are available numerous exercise facilities where humans can go to achieve the desired exercise. There are a substantial number of different types of machines that are available to the user in these exercise facilities. However, not always is a user able to take the time to go to the exercise facility. A busy person may only have available a limited amount of time, and if that person could use an exercising piece of equipment that would be able to duplicate many of the functions of the machines within the exercising facility within his or her own home, such an exercising device would be most desirable. Also, people frequently travel. It would be desirable to construct an exercising device that is light in weight, small in size, and readily portable that can be carried in the baggage of the user when the user is traveling, with this exercise device to then be used within one's hotel or motel room.

SUMMARY OF THE INVENTION

One of the advantages of the present invention is to construct a lightweight exercise device which can be manufactured at a relatively low cost and thereby sold to the ultimate consumer at a low cost.

Another objective of the present invention is to construct an exercising device which is readily portable and can be carried with the user when travelling and is usable within places of temporary accommodation.

Another objective of the present invention is to construct an exercising device which is connectable with a door which is always available within any home or building.

The exercising device of the present invention utilizes an elongated elastic cord with a handle assembly being mounted at each end of the cord. Attached to the approximate midpoint of the cord is a loop strap. This loop strap is to be conducted through a doorjamb with the loop then being mounted about a doorknob that is mounted on the door. Once the loop strap is mounted on the doorknob, the door is then closed with the loop strap being bound between the door and the jamb. The user is to then use the exercising device by grabbing of the handle assemblies and stretching of the elastic cord by applying a force in a direction away from the door.

DETAILED DESCRIPTION OF THE PREFERRED EMBODIMENT

Figure 1:
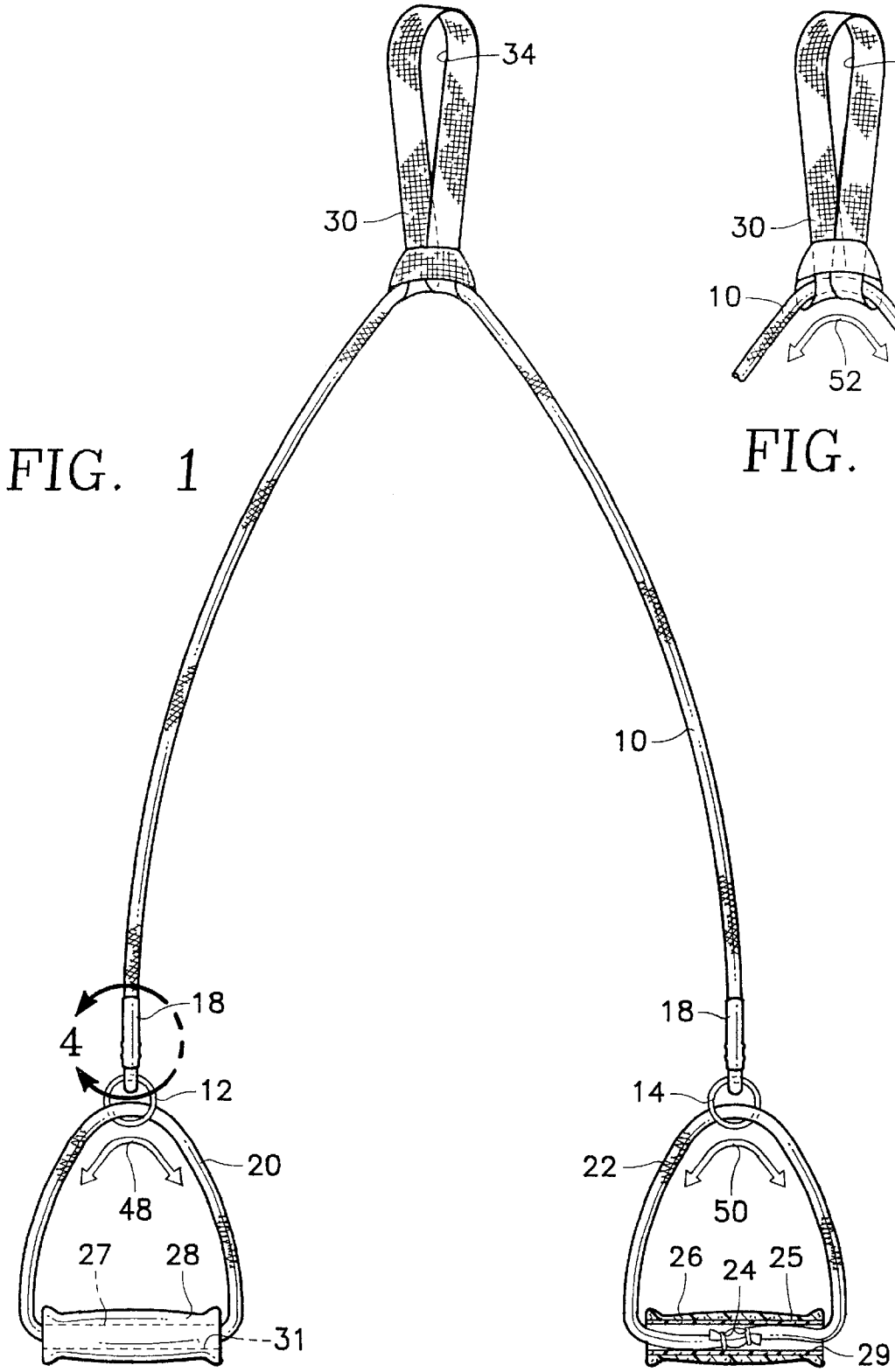
FIG. 1 is a top plan view of the exercising device of the present invention showing the connection of the elastic cord with a tightened loop strap.

Referring particularly to the drawings, there is shown an elongated elastic cord 10. Normally, the cord 10 will be in the range of one quarter to one half inch in diameter. The cord 10 will generally be constructed of rubber and fabric. The cord 10 can be substantially stretched beyond it's at-rest configuration, and when stretched, applies a resistance or a force tending to return the cord 10 to the at-rest configuration. The greater the amount of stretching, the greater the amount of force.

At one end of the cord 10 there is attached a ring 12. The opposite end of the cord 10 is connected to a ring 14. The rings 12 and 14 are identical and generally will be constructed of metal. The attachment of the cord 10 to the rings 12 and 14 is accomplished by doubling over of the end of the cord 10 and securing of the end of the cord 10 by means of a pair of clamping bands 16. For aesthetic purposes, the bands 16 are covered by a fabric or plastic cover 18. Generally, the rings 12 and 14 will define an internal opening of about an inch in diameter.

Extending through the center opening of the ring 12 is a cord loop 20. A similar cord loop 22 extends through the center opening defined by the ring 14. The cord loop 22 has ends which are secured together by means of clamp bands 24. Mounted on the cord loop 22 covering the clamp bands 24 is a rigid tube 25. A similar rigid tube 27 is mounted on the cord loop 20. A plastic foam handle sleeve 26 is fixed onto rigid tube 25. A similar plastic foam handle sleeve 28 is fixed onto rigid tube 27. Cord loop 22 passes through hole 29 of rigid tube 25. Cord loop 20 passes through hole 31 of rigid tube 27. Handle sleeve 26 is freely rotatable on the cord loop 22. Also, the handle sleeve 28 is freely rotatable on the cord loop 20.

Figure 2:
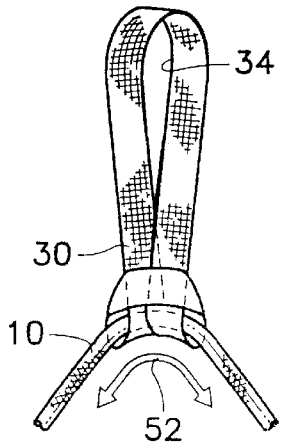
FIG. 2 is a segmental view of the loop strap of FIG. 1 showing it in a loose configuration with the stretchable elastic cord.
Figure 3:
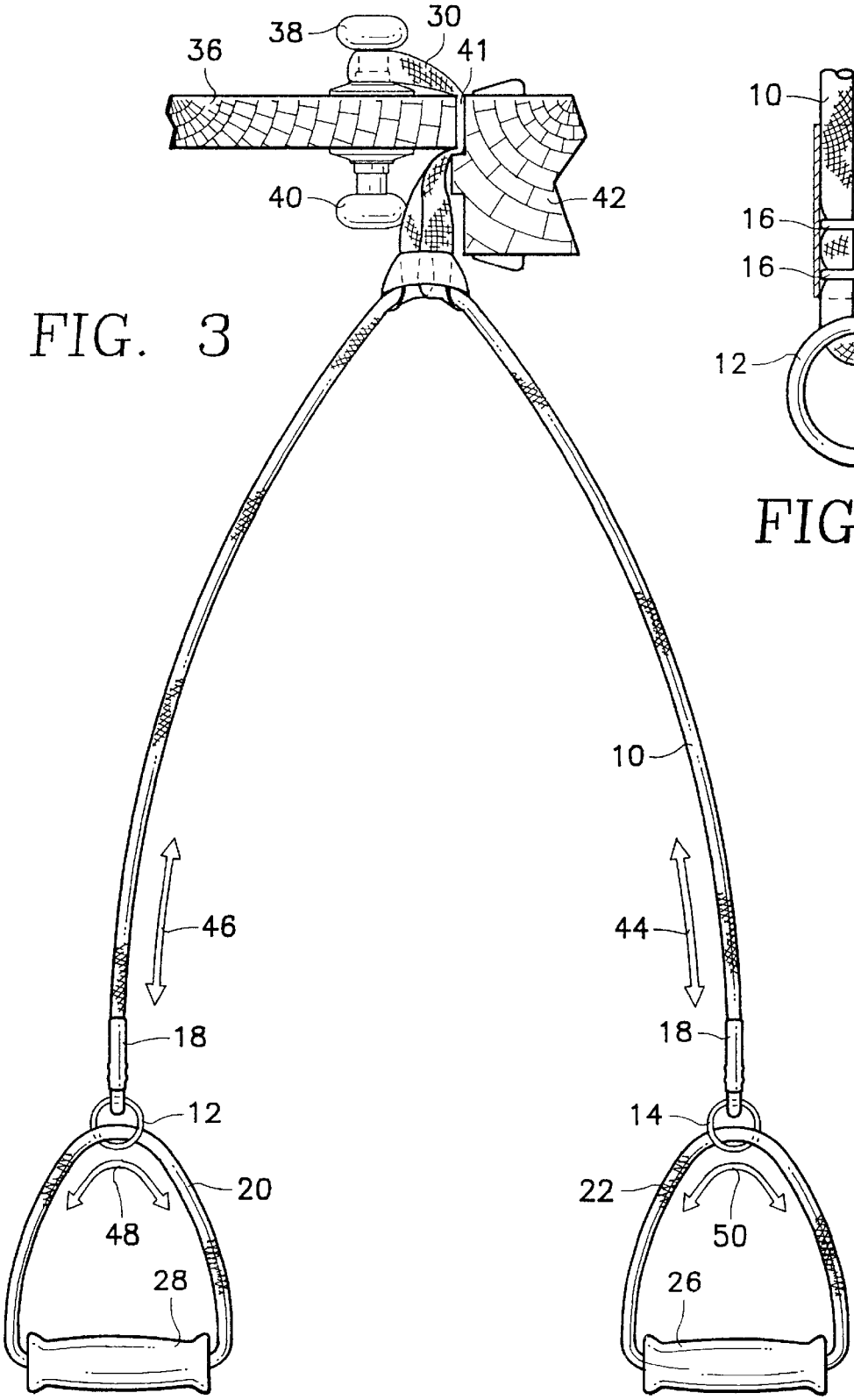
FIG. 3 is a top plan view similar to FIG. 1 but showing the loop strap being mounted in conjunction with a doorknob and the loop strap extending between the door and the doorjamb.
Figure 4:
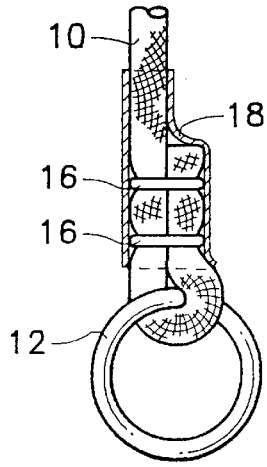
FIG. 4 is a side elevational view showing more clearly the connection between an end of the elastic cord and one of the handle assemblies.

Mounted on the elastic cord 10 at its approximate midpoint is a loop strap 30. The loop strap 30 encloses an opening 34. The loop strap 30 is attached to the elastic cord 10 by means of a slip knot configuration attachment which can either be placed in a tightened configuration, as shown in FIG. 1, or a loose configuration, as shown in FIG. 2. When in the tightened configuration, each of the legs of the elastic cord 10 basically will function independently of each other. However, when in the loose configuration, as shown in FIG. 2, each of the legs of the elastic cord 10 cooperate together to act as a single unit. What this means is that if the loop strap 30 is in the position in FIG. 2, when a user pulls outwardly on the handle sleeve 26 (with the loop strap 30 fixed in position), the handle sleeve 28 will be caused to move toward the loop strap 30. Also, the opposite is true if an outward motion is applied to the handle sleeve 28. However, when the loop strap 30 is fixedly secured, as shown in FIG. 1, an outward motion of one of the legs of the elastic cord 10 will have no affect on the opposite leg. A leg is defined as that portion of the elastic cord between loop strap 30 and ring 12 and loop strap 30 and ring 14.

In order to use the elastic cord 10 of this invention, the user is to utilize a conventional door 36 which has an exterior doorknob 38 and an interior doorknob 40. The door 36 is to be opened and the opening 34 of the loop strap is placed about the exterior doorknob 38. The loop strap 30 is then to be conducted around the edge of the door 36 with the elongated elastic cord 10 being located directly adjacent the interior doorknob 40. The door 36 is then closed, securely locking in position the loop strap 30 in the space 41 between the door 36 and the doorjamb 42. The user can then grasp the handle sleeves 26 and 28 and apply an outward force against the elastic cord 10 in the direction respectively of arrows 44 and 46. This outward pulling force will pull the door 36 tightly against the doorjamb 42. The loop strap 30 cannot pull free because of being mounted on the exterior doorknob 38. When the outward force is released, the handle sleeves 26 and 28 will be moved inwardly toward the door 36 until the elastic cord 10 is in the at-rest position. Repeated outward motions of the handle sleeves 26 and 28 will result in producing the desired exercising activity. Cord loop 20 is capable of slipping relative to the ring 12 as is also cord loop 22 relative to the ring 14, as is shown respectively by arrows 40 and 50. The reason for this adjustability, as indicated by the arrows 40 and 50, is so the cord loops 20 and 22 will automatically adjust in position relative to the elastic cord 10 during usage of the exercising device. In some exercises, it is desirable to have the elastic cord 10 to slide relative to the loop strap 30 as indicated by arrow 52.

What is claimed is:

1. In combination with a door of a building structure, said door being mounted within an opening and being movable between an open position permitting passage through said opening to a closed position preventing passage through said opening, a jamb surrounding said door, said door having an interior surface and an exterior surface, a doorknob mounted on said exterior surface, an exercising device comprising:

a loop strap slipped over said doorknob;

an elastic cord connected to said loop strap by a slip knot attachment, said loop strap being extended from said exterior surface to directly adjacent but spaced from said interior surface by being conducted between said door and said jamb, said elastic cord terminating in a first end and a second end, said slip knot attachment being tightenable onto said elastic cord which permits said first end and said second end to each be stretchable independent of each other;

a first handle assembly attached by first connection means to said first end; and a second handle assembly attached by second connection means to said second end, whereby said first handle and said second handle are to be grasped by a human with a force to be applied in a direction away from said door causing stretching of said elastic cord with said door in said closed position and said loop strap being secured to said door and said doorknob.

2. The combination as defined in claim 1 wherein:

with said slip knot attachment in a loose configuration said elastic cord being slidably mounted on said loop strap to thereby permit variance of the distance between said first handle assembly and said loop strap and said second handle assembly and said loop strap during usage of said exercising device.

3. The combination as defined in claim 1 wherein:

said loop strap being initially mounted at the approximate midpoint of the length of said elastic cord.

4. The combination as defined in claim 1 wherein:

said first handle assembly being identical to said second handle assembly.

5. The combination as defined in claim 1 wherein:

said first handle assembly including a first cord loop, said first connection means comprising a first ring, said first cord loop being conducted through said first ring providing a slip connection between said first cord loop and said ring.

6. The combination as defined in claim 1 wherein:

said second handle assembly including a second cord loop, said second connection means comprising a second ring, said second cord loop being conducted through said second ring providing a slip connection between said second cord loop and said ring.

* * * * *